United States Patent [19]

Battles

[11] 4,223,873

[45] Sep. 23, 1980

[54] DIRECT FLAME LADLE HEATING METHOD AND APPARATUS

[75] Inventor: Donald D. Battles, Atlanta, Ga.

[73] Assignee: The Cadre Corporation, Atlanta, Ga.

[21] Appl. No.: 22,687

[22] Filed: Mar. 21, 1979

[51] Int. Cl.[2] ..... C21C 7/00

[52] U.S. Cl. ..... 266/44; 266/281; 266/901; 75/46; 432/10; 432/224; 432/225

[58] Field of Search ..... 432/10, 224, 225; 266/281, 901, 44; 75/43, 44 R, 44 S, 46

[56] References Cited

U.S. PATENT DOCUMENTS

| | | | |
|---|---|---|---|
| 792,642 | 6/1905 | Williams | 266/141 |
| 1,057,905 | 4/1913 | Widekind | 432/224 |

*Primary Examiner*—M. J. Andrews

*Attorney, Agent, or Firm*—Jones, Thomas & Askew

[57] ABSTRACT

A system for heating ladles prior to the receipt of a charge of molten metal therein, including heating said ladles by direct thermal transfer from the output gases of a heat source, and including waste heat recuperation and controls for maximizing the efficiency of combustion and for maximizing the rate of heating of said ladles without use of excess fuel. The system of the invention includes a heat exchanger defining an opening in its side to directly receive a ladle supported on its side, the heat exchanger including fuel burners for projecting flame and combustion gases directly into the ladle and a heat exchange chamber for directly receiving the hot combustion gases from the ladle for use in preheating inlet gases to be mixed with fuel for combustion in the burners. Means is provided for transporting the heat exchanger horizontally into and out of engagement with the ladle. A control circuit is provided to maintain the combustion gases at a predetermined temperature and to adjust the fuel-air ratio delivered to the burners to maximize combustion and minimize the amount of oxygen remaining in the combustion gases.

9 Claims, 3 Drawing Figures

DIRECT FLAME LADLE HEATING METHOD AND APPARATUS

DESCRIPTION

1. Technical Field

The present invention relates to a method and apparatus for heating ladles, and more particularly to a controlled direct flame ladle heating system including heat recuperation.

2. Background Art

In the ferrous and nonferrous metals industries, ladles receive a charge of molten metal from a furnace. Such ladles, which are lined with a refractory material, must be heated before receiving molten metal to avoid interface solidification of metal upon contact with the interior surface of the ladle, and also to avoid thermal shock to the refractory liner which tends to deteriorate more rapidly if exposed to thermal shock. A preheated ladle also minimizes the heat loss from the molten metal as it is transported from the furnace in the ladle, thereby assisting in maintaining the molten metal at a high enough temperature for use in a casting machine or mold.

A common prior art method for heating ladles prior to charging them with molten metal is to direct an open natural gas flame into an open ladle. The primary disadvantage of this prior art system is a lack of energy efficiency, since combustion gases from within the ladle are allowed to escape directly into the atmosphere. Excessive energy waste is also permitted while maintaining ladles at a desired elevated temperature with the open flame, after the ladles have initially reached such temperature.

SUMMARY OF THE INVENTION

Generally described, the present invention provides an improved system for heating ladles utilizing direct heat transfer from output gases emanating from a heat source associated with the ladle. More particularly, the system for heating a ladle having an open end comprises a heat exchanger defining an air inlet path and an exhaust outlet path, and further defining an open end in the side of the heat exchanger for matingly receiving and enclosing the open end of the ladle, the exhaust outlet path communicating with the interior of the ladle; a fuel burner connected to the air inlet path for directing hot combustion gases through the open end of the heat exchanger into the ladle; a variable fuel supply for mixing fuel with air from the air inlet path and supplying the mixture to the fuel burner; a blower for moving air along the air inlet path to the burner; and a transport means for moving the ladle into and out of engagement with the open end of the heat exchanger, the ladle being oriented such that the open end of the ladle is coaxial with the open end of the heat exchanger.

The method of the invention comprises the steps of enclosing the open end of the ladle with a heat exchanger, the heat exchanger defining an exhaust outlet path communicating with the interior of the ladle and an air inlet path; heating air traveling along the air inlet path by mixing said air with fuel and burning said mixture in a fuel burner; directing the heated air into the ladle; and further heating the air traveling along the air inlet path with hot gases traveling in the exhaust outlet path in said heat exchanger prior to mixing said air with said fuel.

The system of the invention can further include a means for sensing the temperature of the ladle and a means responsive to the temperature sensing means for adjusting the output of the fuel burner to maintain the ladle at a predetermined temperature. The system can also include a means for sensing the amount of oxygen passing through the exhaust outlet path and a means responsive to the oxygen sensing means for adjusting the composition of the fuel-air mixture provided to the fuel burner by the variable fuel supply means to minimize the amount of unburned oxygen in the exhaust outlet path in order to maximize the efficiency of the combustion. Such adjustments responsive to the temperature of the ladle and the amount of un-burned oxygen are interrelated in the system according to the invention so that the adjustment responsive to the unburned oxygen is made at whatever intensity the operation of the burner has been caused to assume by the adjustment means that is responsive to the ladle temperature. The ladle heating system according to the present invention thus has the advantages of energy efficiency resulting from careful control of fuel consumption, recovery of waste heat, and the ability to maintain a ladle at a desired elevated temperature with a minimum of energy consumption.

Thus, it is an object of the present invention to provide an improved method and apparatus for heating ladles utilizing direct heat transfer from the output gases of a heat source.

It is a further object of the present invention to provide a method and apparatus for recuperating and using waste heat generated by such direct heating of ladles.

It is a further object of the present invention to provide a method and apparatus for heating ladles wherein controls are provided to efficiently maintain a ladle at a predetermined temperature.

It is a further object of the present invention to provide a method and apparatus for heating ladles by direct heat transfer from an open flame, wherein the efficiency of combustion is maximized responsive to the amount of oxygen remaining in the combustion gases.

These and other objects and advantages of the present invention will become apparent upon reference to the following description, the attached drawings, and the appended claims.

DETAILED DESCRIPTION

Figure 1:
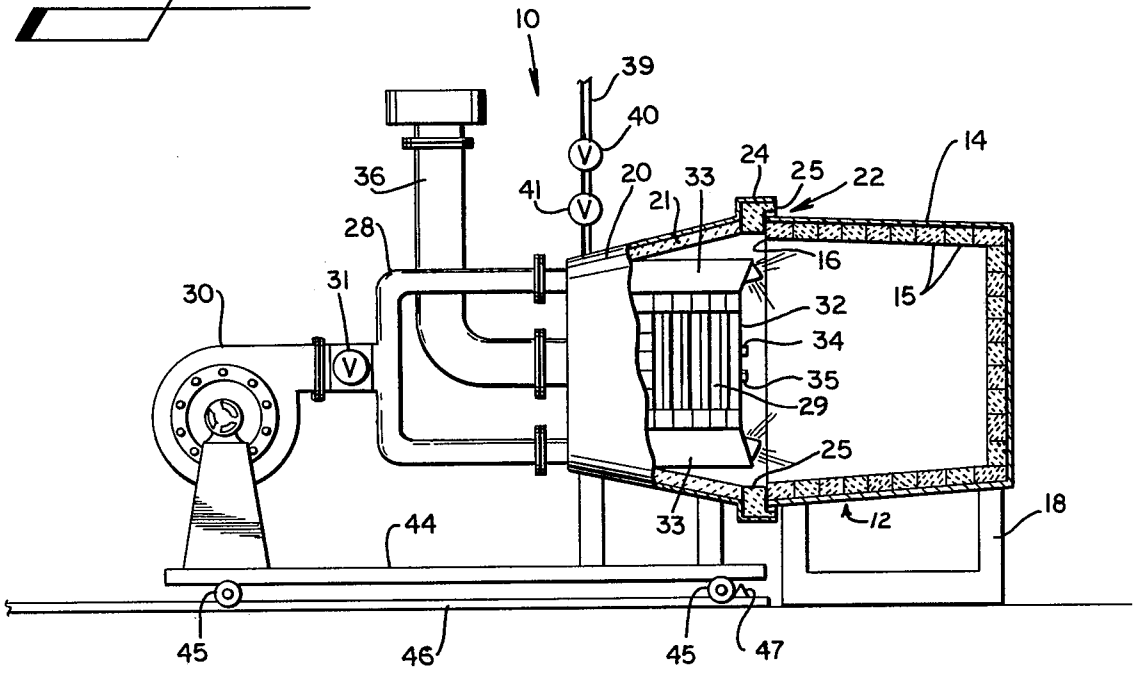
FIG. 1 is a side elevational view of the ladle heating system according to a disclosed embodiment of the present invention, with portions broken away to reveal a vertical cross-section of the ladle and heat exchanger.

Referring now in more detail to the drawing, in which like numerals represent like parts throughout the several views, FIG. 1 is a side elevational view of a ladle heating system 10 according to the invention. For utilization of the invention, a ladle 12 is placed on a support stand 18 with the ladle tipped 90° from its normal vertical orientation such that the open end 16 of the ladle opens in a horizontal direction. The ladle 12 can be a conventional ladle which includes a steel outer wall 14 and a refractory inner lining 15, which can be in the form of bricks.

The ladle heating system 10 according to the invention includes a heat exchanger and burner assembly 20 also having a refractory or otherwise heat-resistant inner lining 21. The heat exchanger and burner assembly 20 has an open end 22 defined by a mouth 24 opening in a horizontal direction at the side of the heat exchanger. The mouth 24 defines a mating opening for receiving the open end 16 of the ladle 12, and holds a circular seal 25 comprising a ceramic fiber compaction material. The material of the seal 25 gives somewhat when engaged by the open end 16 of the ladle 12 to prevent excessive leakage between the interior of the ladle and the outside atmosphere.

Ambient air is directed along an air inlet duct 28 by means of a blower 30 into the assembly 20. The air inlet duct 28 splits into two branches before entering the assembly 20, and the volume of air delivered by the blower 30 is regulated by a variable orifice valve 31 located prior to the branching of the duct 28. After entering the heat exchanger and burner assembly 20, the branches of the air inlet duct 28 are connected to a pair of heat exchange units 29 within the assembly 20, only one of which is visible in FIG. 1. Each heat exchange unit 29 includes an air inlet path and an exhaust outlet path. The air inlet path is connected to one of a pair of fuel burners 33 which are located within the assembly 20 and oriented to project a flame and combustion gases into the ladle 12 to uniformly heat the refractory lining 15 of the ladle 12. The exhaust outlet path defined within each heat exchange unit 29 is open at 32 to the interior of the ladle 12. Within the opening 32 are located a conventional temperature probe 34, such as a thermocouple, and a conventional oxygen probe 35 which detects the amount of oxygen in the gases surrounding the probe by measuring the change in the electrical resistance of the gases. The exhaust outlet path defined within the heat exchange units 29 is also connected to an insulated exhaust duct 36 which communicates with the surrounding atmosphere either directly or through a filter or other pollution control device.

The boundaries between the air inlet path and the exhaust outlet path of the heat exchange units 29 must be constructed of material sufficient to withstand the heat of the combustion gases produced by the burners 33, which can be in excess of 2000° F. A suitable heat recuperator for this purpose is a single pass cross-flow shell and tube heat exchanger with the interior components constructed of ceramic materials. A suitable burner for use in the present invention is manufactured by Hague International, Inc. under the product designation "HI 'TRANSJET' Model 300", using natural gas as a fuel and capable of a heat output of $5.8\times10^6$ BTU/Hr. The burners 33 are supplied with natural gas from a gas supply 38 (shown diagrammatically in FIG. 3) through a fuel supply line 39 which includes a main fuel control valve 40 and an oxygen responsive control valve 41 downstream from the main valve 40.

Figure 3:
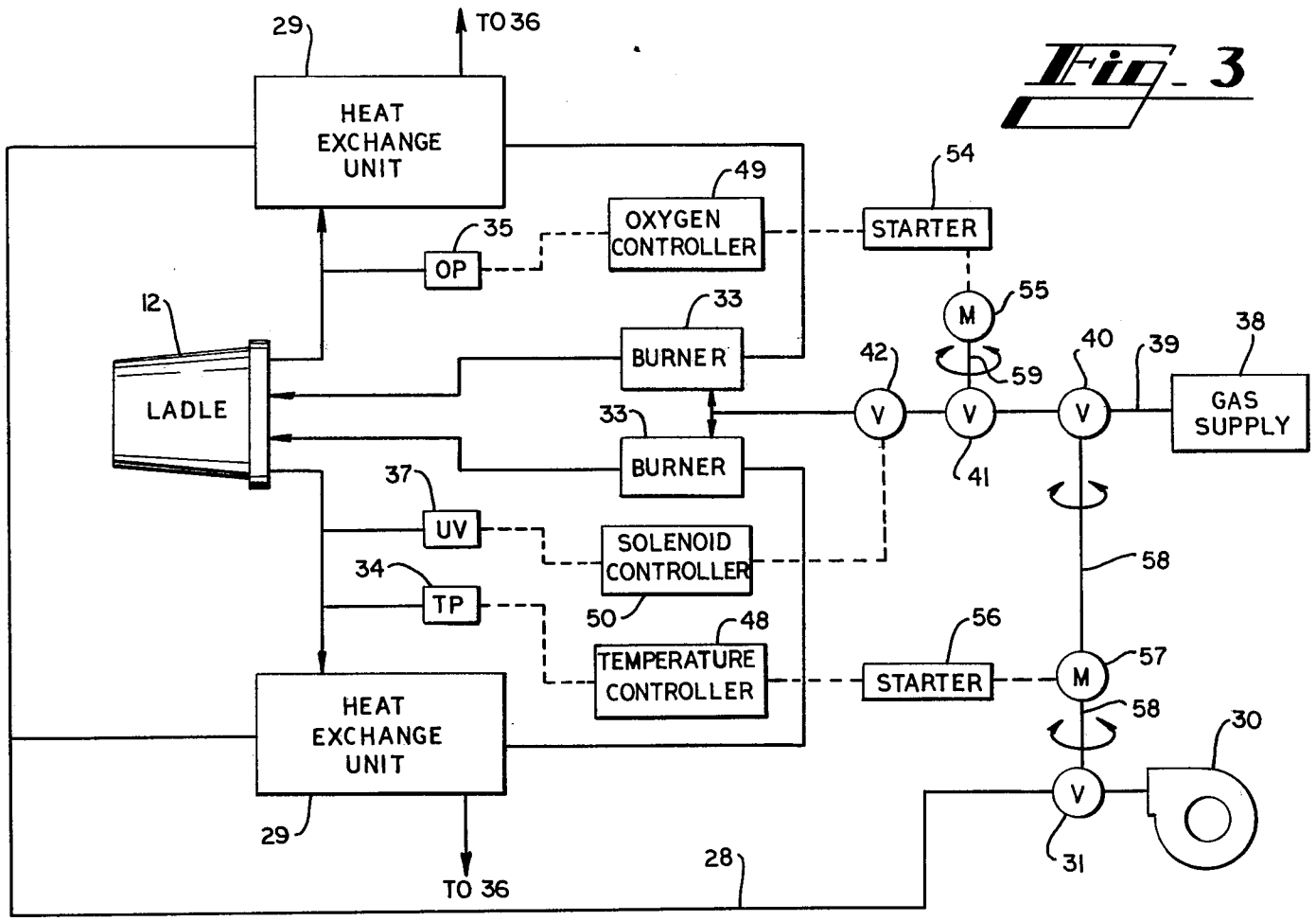
FIG. 3 is a schematic representation of the ladle heating system according to the present invention, including the control circuits.

A schematic diagram of the ladle heating system of the invention including the control system utilized to operate the ladle heating system 10 of the present invention is shown in FIG. 3. Signals are received from the temperature probe 34 at a temperature controller circuit 48. The construction of a controller circuit 48 to perform the functions required is within the capability of those skilled in the art, and is commercially available. The circuit 48 monitors the temperature signal from the temperature probe 34 and compares it to a predetermined temperature. The predetermined temperature is arrived at by correlating empirical measurements of the actual temperature of the ladle 12 and the temperature measured by the probe 34 at the opening 32 to the exhaust outlet path of the heat exchange unit 29, so that the predetermined temperature represents a ladle temperature equal to the temperature to which it is desired to heat the ladle prior to being charged with molten metal. The desired ladle temperature can range from 1600°–2600° F. depending on the type of molten metal to be placed in the ladle. When the temperature mesured by the probe 34 exceeds the predetermined temperature, the controler circuit 48 initiates a starter 56 to operate a motor 57 for a short period of time. The motor 57 is mechanically linked by a linkage 58 to both the air inlet valve 31 and the main fuel valve 40, and thus causes the valve 31 to decrease the amount of air traveling in the air inlet duct 28 and also causes the valve 40 in the fuel line 39 to decrease the amount of fuel being delivered to the burners 33. The temperature of the burner output is thereby decreased. Similarly, when the temperature measured by the temperature probe drops below the predetermined temperature, the control circuit 50 causes the valves 31 and 40 to increase the supply of air and fuel to the burners 33 by operating the motor 57 in a reverse direction.

The oxygen probe 35 located in the opening 32 of a heat exchange unit 29 sends a signal to an oxygen controller circuit 49, which is operable to adjust the oxygen responsive valve 41 in the fuel line 31 in response to the oxygen probe 35. The oxygen controller circuit 49 is also within the capability of those skilled in the art, and is commercially available from Hague International, Inc. under the product designation "OxSen". Whenever the amount of oxygen in the combustion gases as measured by the oxygen probe 35 rises above a predetermined value representing efficient combustion, the controller circuit 49 causes a starter 54 to operate a motor 55 for a short period of time. The motor 55 is connected via a mechanical linkage 59 to the valve 41 which is thereby mechanically opened somewhat to slightly increase the amount of fuel being delivered along the fuel supply line 39 to be mixed with air from the air inlet duct 28 and burned in the burners 33. Likewise, if the oxygen measured by the probe 35 indicates that the fuel-air mixture is too rich relative to the predetermined value of oxygen content, the controller circuit 49 causes the valve 41 to decrease the amount of fuel supplied to the burners 33 by operating the motor 55 in a reverse direction.

The heat exchanger and burner assembly 20 also includes a flame out safety fuel shutdown system. An ultraviolet sensor 37, shown diagrammatically in FIG. 3, is located within the assembly 20 in suitable position to monitor the radiation emitted by the burners 33 when in operation. If for any reason the burner flame is extinguished while fuel is being supplied, the absence of radiation is sensed by the ultraviolet sensor 37 and a signal is received from the sensor 37 at a solenoid controller circuit 50. The circuit 50 is operatively connected to a solenoid operated valve 42 in the fuel supply line 39 and closes the valve 42 in response to the flame out signal from the sensor 37. The controller circuit 50 is of conventional construction and is commercially available.

The assembled heat exchanger and burner assembly 20, blower 30 and ducts 28 and 36 are mounted on a motorized transporter 44 which runs on wheels 45 along rails 46. The assembly 20 is selectively moved horizontally along the rails 46 by a propulsion means (not shown) of any conventional type known to those skilled in the art. Travel of the transporter 44 along the rails 46 is limited by an end stop 47.

In operation of the ladle heating system 10, a ladle 12 is first placed on its side on the stand 18 at the end of the rails 46 by any conventional means such as an overhead crane. The transporter 44, initially located in spaced relation from the end stop 47, is then moved horizontally until the transporter 44 rests against the end stop 47 and the seal 25 within the mouth 24 of the heat exchanger and burner assembly 20 is engaged with the open end 16 of the ladle 12. At such time the operation of the blower 30 is initiated to deliver air along the inlet duct 28. After traveling through the inlet air path of the heat exchange units 29, the air is mixed with fuel from the fuel line 39 and the mixture is ignited in the burner. Flame and combustion gases from the burners 33 heat the refractory lining 15 of the ladle 12. The hot combustion gases escape from the interior of the ladle 12 through the opening 32 of the heat exchange units 29 into the exhaust outlet path of the heat exchange units 29.

While passing through the heat exchange units 29, the hot exhaust gases transfer heat to the inlet air passing through the inlet air path of the heat exchange units 29. Preheating of the inlet air before mixture with fuel for combustion makes the operation of the burners 33 more efficient. After passing through the exhaust outlet path of the heat exchange units 29, the hot combustion gases are exhausted through the exhaust conduit 36.

As the combustion gases pass over the oxygen probe 35, the amount of oxygen in the combustion gases is monitored by the probe, and a signal providing such information is transmitted from the oxygen probe 39 to the oxygen controller circuit 49. If the amount of oxygen measured by the probe 35 is higher than a predetermined value, the controller circuit 49 causes the oxygen responsive valve 41 to allow more fuel to be mixed with the inlet air in order to more fully burn the oxygen in the inlet air. If the amount of oxygen measured by the probe 35 becomes too small, the fuel-air ratio is decreased to maintain optimum combustion conditions in the burners 33.

The hot combustion gases also pass over the temperature probe 34 which monitors the temperature of the gases as they enter the heat exchange units 29. In response to the measured temperature rising above a predetermined value, the temperature controller circuit 48 lowers the output of the burners 33 by simultaneously gradually closing the blower valve 31 and the main fuel valve 40 in the fuel line 39. Thus, when the burners are initially ignited, they can run at full capacity and the relatively cool ladle 12 will rapidly absorb the heat of the combustion gases. As the ladle becomes heated, it will less readily absorb heat and the temperature of the combustion gases at the temperature probe 34 will rise. For example an unheated 55 ton ladle would accept heat initially at a rate of about eleven million BTU/Hr, but would eventually reach a stabilized condition. In such a condition only about two million BTU/Hr are required to maintain the elevated temperature of the ladle.

By maintaining the temperature of the combustion gases at the predetermined value, the control system of the present invention heats the ladle 12 at the maximum rate possible, while maintaining energy efficiency by operating the burners 33 to provide the maximum level of heat which the ladle 12 can absorb at any particular time during the heating of the ladle. The intensity of the burners is thus gradually throttled down from maximum output to minimum output, during the course of a typical ladle heating operation. If, during a holding period after the ladle has been heated to the required temperature for receipt of molten metal, the temperature of the combustion gases drops below the predetermined value, the controller circuit 48 causes the valves 31 and 40 to increase the intensity of the burner and thereby maintain the ladle in its heated state.

It will be seen that the control system is designed so that the fine tuning of the fuel-air ratio provided by the oxygen controller 49 operates effectively at whatever level of intensity the burners 33 assume in response to the temperature of the combustion gases as measured by the temperature probe 34 and regulated by the temperature controller 48.

When the ladle has reached the desired temperature and is needed to receive a charge of molten metal, the transporter 44 is moved horizontally along the rails 46 to remove the heat exchanger 20 from engagement with the open end 16 of the ladle 12. The ladle 12 may then be removed from the stand 18 and delivered to a station for receiving molten metal from a furnace. It should be understood that the ladle heating system 10 could alternatively be fixed in position, and that the transporter would be located to convey the ladle 12 between the position shown in FIG. 1 engaging the heat exchanger, and a position spaced apart from the fixed system for engagement by an overhead crane or the like. Moreover, the ladle heating system 10 can alternatively be oriented vertically so as to receive a ladle in upright position; suitable manipulating apparatus would be required to move the system and/or the ladle into and out of contact.

Figure 2:
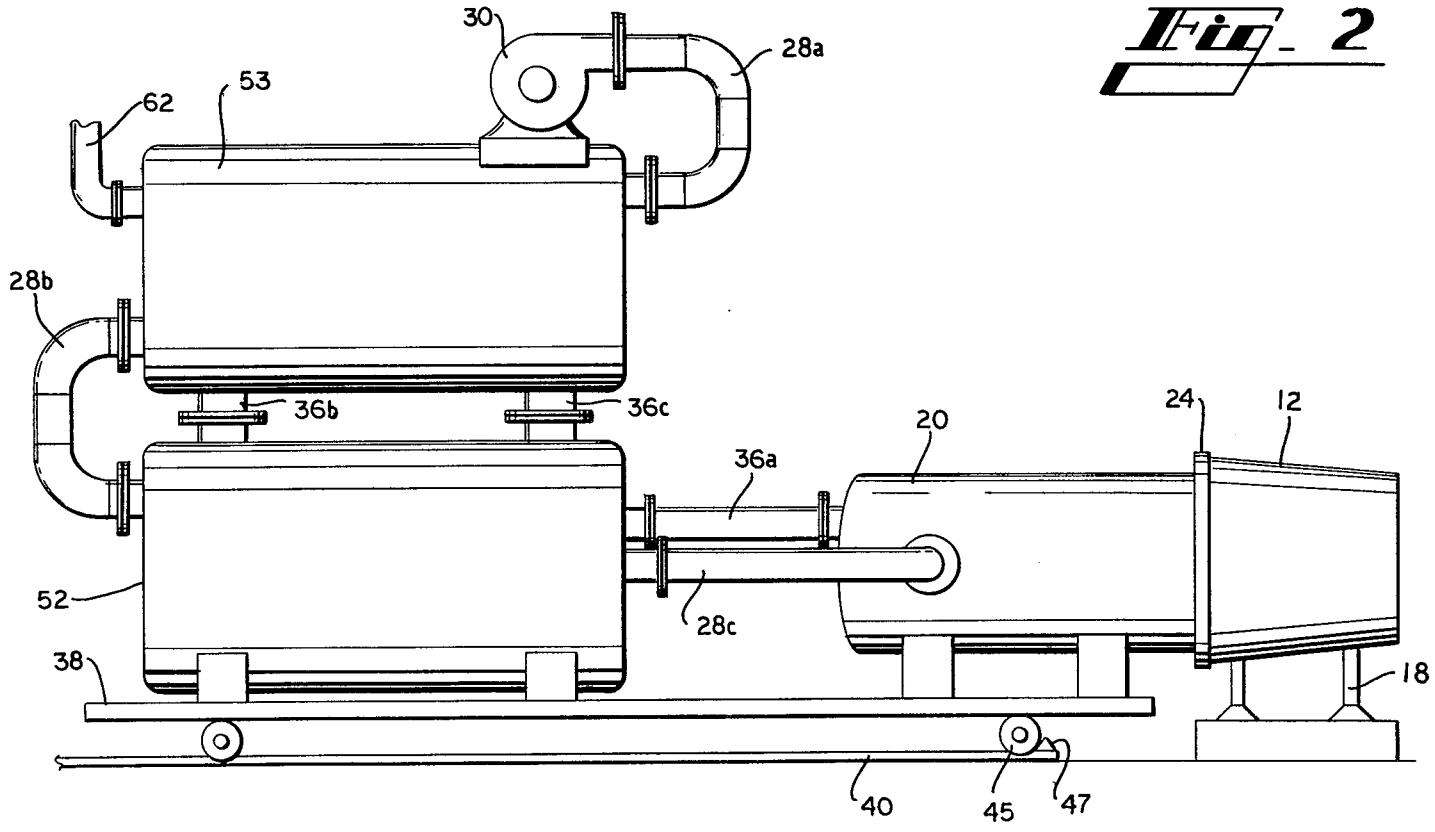
FIG. 2 is a side elevational view of a second embodiment of a ladle heating system according to the invention.

A second embodiment of the present invention is shown in FIG. 2, which depicts a ladle heating apparatus 60. The ladle heating apparatus 60 is similar in all respects to the apparatus shown in FIG. 1, with the exception that two additional heat exchangers, a stainless steel heat exchanger 52 and a carbon steel heat exchanger 53, are included in the system. Thus, the blower 30 delivers air through an inlet conduit **28*a* to an inlet air path within the heat exchanger 53, through a connecting inlet duct 28*b* to an inlet air path within the heat exchanger 52, and thereafter through an inlet air duct 28*c* to the ceramic heat exchanger and burner assembly 20 which includes the burners 33 and engages the ladle 12. After heating inlet gases in the assembly 20, the hot combustion gases pass through an exhaust duct 36*a* to the exhaust path of the stainless steel heat exchanger 52, through exhaust ducts 36*b* and 36*c* to the exhaust path within the carbon steel heat exchanger 53, and thereafter are exhausted to atmosphere through a duct 62. The three heat exchangers of the embodiment shown in FIG. 2 cooperate to recuperate as much waste heat as possible from the combustion gases leaving the ladle 12. The ceramic heat exchanger and burner assembly 20 is constructed of materials capable of withstanding the combustion gas temperatures, which are in excess of 2000° F., and transfers heat from such gases to the inlet air stream. The stainless steel heat exchanger is capable of withstanding the exhaust gases of intermediate temperature after heat has been extracted therefrom by the ceramic heat exchanger. Similarly, the carbon steel heat exchanger 53 is efficient in transferring heat from the relatively low temperature exhaust gases prior to exhausting said gases to the atmosphere. Operation of the embodiment of the invention shown in FIG. 2 is essentially similar to that described for the embodiment shown in FIG. 1**.

Now that the ladle heating system according to the invention has been described in detail, it will be understood by those skilled in the art that the principles of waste heat recuperation and heating control may be applied to systems utilizing heat sources other than natural gas flame burners.

While this invention has been described in detail with particular reference to preferred embodiments thereof, it will be understood that variations and modifications can be effected within the spirit and scope of the invention as described hereinbefore and as defined in the appended claims.

I claim:

1. An apparatus for heating a ladle having an open end comprising:

seal means comprising ceramic fiber compaction material sized and shaped to engage the ladle about its open end and defining an opening therethrough;

a ceramic heat exchanger defining an air inlet path and an exhaust outlet path for communicating through the opening of said seal means with the interior of the ladle;

a fuel burner means connected to said air inlet path for directing hot combustion gases through the opening of said seal means into the open end of the ladle;

variable fuel supply means for mixing fuel with air from said air inlet path and supplying said mixture to said fuel burner means; and blower means for moving air along said air inlet path to said burner means;

whereby the seal means forms resilient contact with the open end of the ladle and air from said blower means moves through the heat exchanger, past the fuel supply means, through the fuel burner and through the opening of the seal means and forms a flame to heat the inside surfaces of the ladle and the hot gases from inside the ladle move back through the seal means and through the heat exchanger to preheat the air moving from the blower means through the heat exchanger.

2. The apparatus of claim 1 further comprising:

means for sensing the temperature of said ladle; and means responsive to said temperature sensing means for adjusting the output of said fuel burner means to maintain said ladle at a predetermined temperature.

3. The apparatus of claim 1 and wherein said ceramic heat exchanger includes a multiple stage heat exchanger with a first stage fabricated from ceramic materials for receiving the hottest gases from the ladle and at least one more heat exchanger fabricated from other materials for receiving the hot gases in sequence from said ceramic heat exchanger.

4. A method of heating a ladle having an open end comprising the steps of:

enclosing said open end of said ladle with a heat exchanger, said heat exchanger defining an exhaust outlet path communicating with the interior of said ladle and an air inlet path;

heating air traveling along said air inlet path by mixing said air with fuel and burning said mixture in a fuel burner;

directing said heated air into said ladle;

further heating said air traveling along said air inlet path with hot gases traveling in said exhaust outlet path in said heat exchanger prior to mixing said air with said fuel;

measuring the amount of oxygen in said hot gases traveling along said exhaust outlet path; and in response to the amount of oxygen in said exhaust outlet path, regulating the fuel-air mixture provided to said fuel burner to maintain the amount of oxygen in said exhaust outlet path at a predetermined value.

5. The method of claim 4 further comprising the steps of:

sensing the temperature of said ladle; and responsive to the temperature of said ladle being other than a predetermined value, adjusting the heating of said air traveling in said air inlet path with said fuel burner to maintain said predetermined temperature.

6. An apparatus for heating a ladle having an open end comprising:

a heat exchanger defining an air inlet path and an exhaust outlet path, and further defining an open end for matingly receiving and enclosing said open end of the ladle, said exhaust outlet path and said air inlet path communicating through said open end of said heat exchanger with the interior of said ladle;

a fuel burner means in communication with to said air inlet path for directing hot combustion gases through said open end of said heat exchanger into the ladle;

variable fuel supply means for mixing fuel with air from said air inlet path and supplying said mixture to said fuel burner means;

blower means for moving air along said air inlet path to said burner means;

said heat exchanger comprising a ceramic heat exchange means for receiving said hot combustion gases directly from the interior of said ladle, a stainless steel heat exchange means communicating with said ceramic heat exchange means for receiving said hot combustion gases from said ceramic heat exchange means, and a carbon steel heat exchange means communicating with said stainless steel heat exchange means for receiving said hot combustion gases from said stainless steel heat exchange means; and said air inlet path extending from said blower through said carbon steel heat exchange means, then through said stainless steel heat exchange means, and then through said ceramic heat exchange means to said fuel burner means.

7. An apparatus for heating a ladle having an open end comprising:

a heat exchanger defining an air inlet path and an exhaust outlet path, and further defining an open end at the side of said heat exchanger for matingly receiving and enclosing the open end of said ladle, said exhaust outlet path communicating with the interior of said ladle;

a fuel burner means communicating with said air inlet path for directing hot combustion gases through said open end of said exchanger into said ladle;

variable fuel supply means for mixing fuel with air from said air inlet path and supplying said mixture to said fuel burner means;

blower means for moving air along said air inlet path to said burner means;

means for sensing the temperature of the ladle;

means responsive to said temperature sensing means for adjusting the output of said fuel burner means to maintain the ladle at a predetermined temperature;

means for sensing the amount of oxygen passing through said exhaust outlet path; and means responsive to said oxygen sensing means for adjusting the composition of said fuel-air mixture provided to said fuel burner means by said variable fuel supply means to maintain the amount of oxygen passing through said exhaust outlet path at a predetermined value.

8. The apparatus of claim 7 wherein said means for adjusting the amount of fuel provided to said fuel burner means to maintain the amount of oxygen through said exhaust outlet path at a predetermined value operates at any particular output level of said fuel burner means determined by said means for adjusting the output of said fuel burner means to maintain said ladle at a predetermined temperature.

9. The apparatus of claim 8 further comprising a safety fuel cut-off means for terminating operation of said variable fuel supply means in response to said burner being extinguished.

* * * * *